US009459585B2

(12) United States Patent
Yoshikawa et al.

(10) Patent No.: US 9,459,585 B2
(45) Date of Patent: Oct. 4, 2016

(54) IMAGE FORMING APPARATUS HAVING OPENING FOR REPLACEMENT OF CARTRIDGE

(71) Applicant: Brother Kogyo Kabushiki Kaisha, Nagoya (JP)

(72) Inventors: Masanari Yoshikawa, Nagoya (JP); Yasushi Okabe, Nagoya (JP)

(73) Assignee: Brother Kogyo Kabushiki Kaisha, Nagoya-Shi (JP)

( * ) Notice: Subject to any disclaimer, the term of this patent is extended or adjusted under 35 U.S.C. 154(b) by 0 days.

(21) Appl. No.: 14/475,607

(22) Filed: Sep. 3, 2014

(65) Prior Publication Data

US 2015/0093125 A1 Apr. 2, 2015

(30) Foreign Application Priority Data

Sep. 30, 2013 (JP) ..... 2013-203672

(51) Int. Cl.
*G03G 21/18* (2006.01)
*G03G 15/00* (2006.01)
*G03G 21/16* (2006.01)

(52) U.S. Cl.
CPC ..... *G03G 21/1842* (2013.01); *G03G 15/6529* (2013.01); *G03G 21/1604* (2013.01); *G03G 21/1628* (2013.01); *G03G 21/1638* (2013.01)

(58) Field of Classification Search
CPC ..... G03G 21/1623; G03G 21/1628; G03G 21/1671; G03G 21/1676; G03G 21/1842; G03G 21/1803
USPC ..... 399/125
See application file for complete search history.

(56) References Cited

U.S. PATENT DOCUMENTS 4,589,758 A * 5/1986 Kasama et al. ..... 399/122
5,083,158 A * 1/1992 Kashima ..... G03G 21/1832 399/114
5,126,796 A 6/1992 Fujii et al.
5,168,308 A 12/1992 Hiraike et al.
5,323,210 A * 6/1994 Inomata ..... G03G 15/01 399/113
5,543,891 A * 8/1996 Setoriyama ..... G03G 21/1853 399/111
6,099,097 A * 8/2000 Hocker et al. ..... 312/327

(Continued)

FOREIGN PATENT DOCUMENTS

JP 03-107169 A 5/1991
JP 03-256057 A 11/1991

(Continued)

*Primary Examiner* — Justin Olamit
(74) *Attorney, Agent, or Firm* — Burr & Brown, PLLC

(57) ABSTRACT

An image forming apparatus includes a cartridge, a first unit, and a second unit. The first unit includes a sheet discharge tray and a guide. The cartridge has an accommodating portion configured to accommodate a color material. The guide is positioned below the sheet discharge tray and is configured to guide the cartridge to its assembled position. The first unit has an opening directing downward, and the guide has a lower end. The second unit includes a sheet supply tray positioned below the guide. The first unit and the second unit are pivotally movably connected to each other about a pivot axis to provide a first position and a second position. In the first position, the opening is closed by the second unit and the lower end of the guide is directed toward the sheet supply tray. In the second position, the opening is exposed to an outside.

14 Claims, 13 Drawing Sheets

(56) References Cited

U.S. PATENT DOCUMENTS

| | | | | |
|---|---|---|---|---|
| 6,473,591 | B2 * | 10/2002 | Kominato | 399/405 |
| 7,404,894 | B2 * | 7/2008 | Yamaguchi | 210/232 |
| 7,515,867 | B2 * | 4/2009 | Yano | 399/393 |
| 2003/0052956 | A1 | 3/2003 | Katsuyama | |

FOREIGN PATENT DOCUMENTS

| | | | |
|---|---|---|---|
| JP | 07-334065 | A | 12/1995 |
| JP | 2003-089249 | A | 3/2003 |
| JP | 2005-088219 | A | 4/2005 |
| JP | 2012-168570 | A | 9/2012 |

* cited by examiner

IMAGE FORMING APPARATUS HAVING OPENING FOR REPLACEMENT OF CARTRIDGE

CROSS REFERENCE TO RELATED APPLICATION

This application claims priority from Japanese Patent Application No. 2013-203672 filed Sep. 30, 2013. The entire content of the priority application is incorporated herein by reference.

TECHNICAL FIELD

The present invention relates to an image forming apparatus provided with a cartridge.

BACKGROUND

Japanese Patent Application Publication No. 2012-168570 discloses an image forming device including a front cover acting as a sheet supply tray, and a rear cover for allowing access to internal components. Opening the rear cover can permit a user to remove sheet(s) jamming at a deep end portion of the device and to replace a damaged component with a new component.

SUMMARY

Facilitation of jammed sheet removing process and facilitation of replacement of a cartridge are desired in the image forming apparatus in which the cartridge is attachable to and detachable from a main frame.

Thus, it is an object of the invention to provide an image forming apparatus capable of facilitating jammed sheet removal work and replacement of a cartridge.

In order to attain the above and other objects, the invention provides an image forming apparatus that may include a cartridge, a first unit, and a second unit. The cartridge may have an accommodating portion configured to accommodate a color material. The first unit may include a sheet discharge tray and a guide. The guide may be positioned below the sheet discharge tray and be configured to guide the cartridge to its assembled position. The first unit may have an opening directing downward, and the guide having a lower end. The second unit may include a sheet supply tray positioned below the guide. The first unit and the second unit may be pivotally movably connected to each other about a pivot axis to provide a first position and a second position. In the first position, the opening may be closed by the second unit and the lower end of the guide may be directed toward the sheet supply tray. In the second position, the opening may be exposed to an outside.

DETAILED DESCRIPTION

Figure 1:
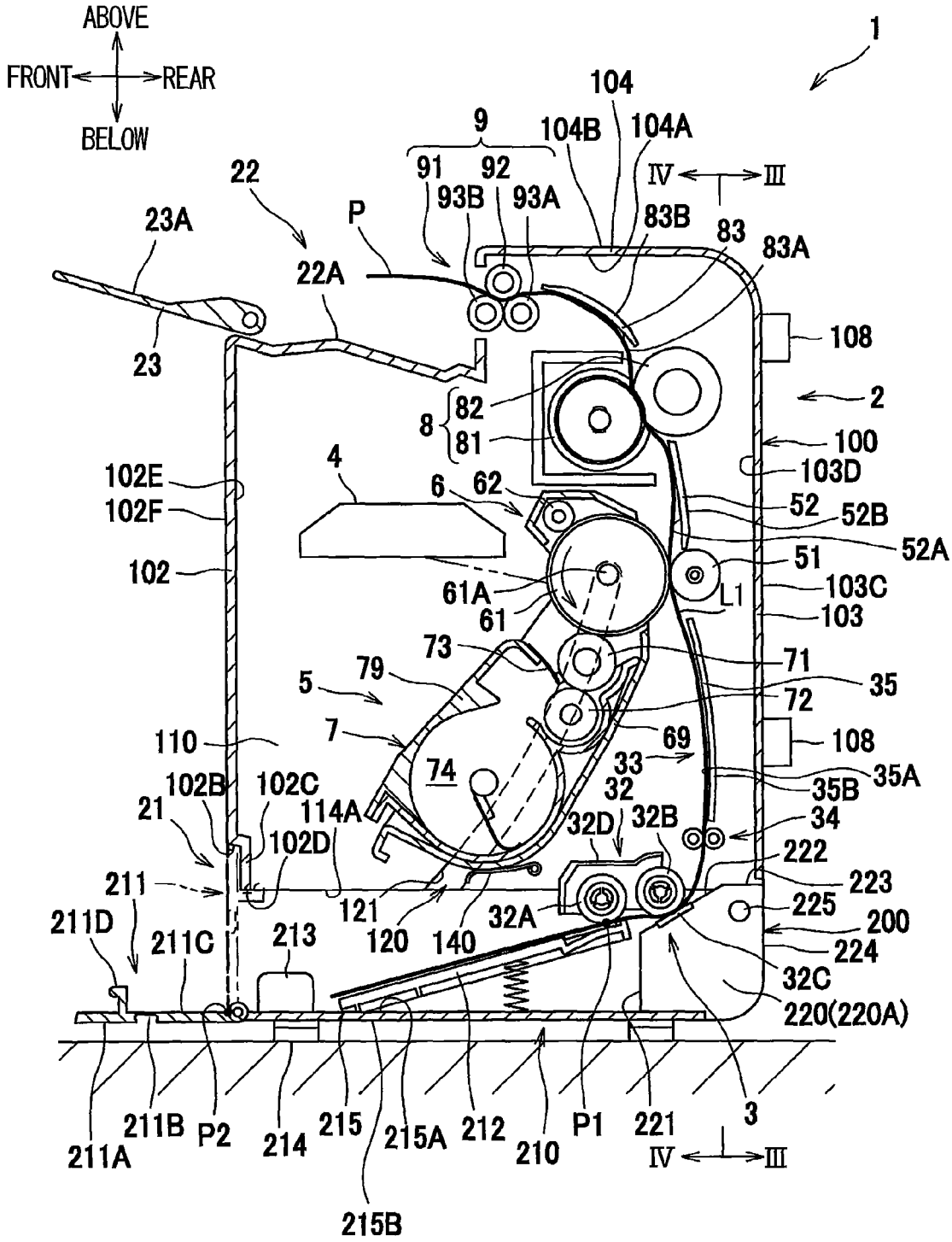
FIG. 1 is a cross-sectional view of a laser printer as an example of an image forming apparatus according to a first embodiment of the present invention.

An image forming apparatus according to a first embodiment of the present invention will be described with reference to FIGS. 1 through 7. The terms "upward", "downward", "upper", "lower", "above", "below", "beneath", "right", "left", "front", "rear" and the like will be used throughout the description assuming that the laser printer 1 is disposed in an orientation in which it is intended to be used. In use, the laser printer 1 is disposed as shown in FIG. 1 where a left side and a right side of a drawing sheet will be referred to as a "front side" and a "rear side" of the device, and an upper side and a lower side of the drawing sheet will be referred to as an "upper side" and a "lower side" of the device, and a near side and a back side of the drawing sheet will be referred to as a "right side" and a "left side" of the device.

[Overall Structure of the Laser Printer]

As shown in FIG. 1, the laser printer 1 includes a first unit 2 and a second unit 200 pivotally movably supported to the first unit 2 about a pivot axis. More specifically, the laser printer 1 includes a main casing 100 as an outer frame of the first unit 2, a feeder portion 3, a scanner unit 4, a process cartridge 5 as an example of a cartridge, a fixing unit 8, and a discharge portion 9. The main casing 100 includes a main frame 110 (FIG. 3) in which the above described portion and units 3, 4, 5, 8, and 9 are supported. Incidentally, the first unit 2 includes the main casing 100, a part of the feeder portion 3, the scanner unit 4, the process cartridge 5, the fixing unit 8, and the discharge portion 9, and the second unit 200 includes a part of the feeder unit 3.

The feeder portion 3 is constituted by the second unit 200 and a sheet feed portion 32 of the first unit 2. The second unit 200 is positioned at a lower portion of an interior of the first unit 2, and includes a sheet supply tray 210 functioning as a part of the feeder portion 3, and a connecting portion 220 positioned at a rear end portion of the sheet supply tray 210 and connected to the first unit 2.

The sheet supply tray 210 is positioned below the guide 120 in a state of FIG. 1 and includes a bottom plate 215, a front cover 211, a lifter plate 212, a side guide 213, and four bottom stems 214. The bottom plate 215 has an upper surface 215A and a lower surface 215B, and a front end portion. The front cover 211 is pivotally movably connected to the front end portion. The lifter plate 212 serving as an example of a pressure member is positioned on the bottom plate 215 and is configured to press the sheet P on the sheet supply tray 210 toward the pick-up roller 32A. The side guide 213 is positioned on the upper surface 215A of the bottom plate 215 and is adapted for regulating a position of the sheet P. The bottom stems 214 protrude downward from the lower surface 215B and are made from rubber. Two bottom stems 214 are positioned at left and right sides of the front end portion of the bottom plate 215, and remaining two bottom stems 214 are positioned at left and right sides of the rear end portion thereof.

The main casing 100 has a front lower portion formed with a sheet insertion opening 21, and includes a front wall 102 having a front outer surface 102F, and an engagement portion 102C positioned at an upper edge of the sheet insertion opening 21. The front outer surface 102F serves as an example of the outer wall surface. The front cover 211 is configured to open and close the sheet insertion opening 21, and has an outer surface 211A, a grasping portion 211B, an inner surface 211C, and a pawl portion 211D. In the open position of the front cover 211, the inner surface 211C facing upward is positioned frontward of the front outer surface 102F so as to constitute a part of a sheet seating surface. The outer surface 211A becomes a front surface when the front cover 211 closes the sheet insertion opening 21. The grasping portion 211B is recessed toward the inner surface 211C from the outer surface 211A. The pawl portion 211D protrudes from the inner surface 211C and is engageable with the engagement portion 102C. Upon engagement of the pawl portion 211D with the engagement portion 102C, closing state of the front cover 211 can be maintained.

The connecting portion 220 has a front wall 221, a slant wall 222 extending diagonally upward and rearward from an upper end of the front wall 221, an upper wall 223 extending rearward from a rear end of the slant wall 222, a rear wall 224 extending downward from a rear end of the upper wall 223, and lateral side walls 220A. (In FIG. 1, only a right side wall 220A is shown). The main frame 110 has an opening 111 (see FIG. 3).

Figure 2:
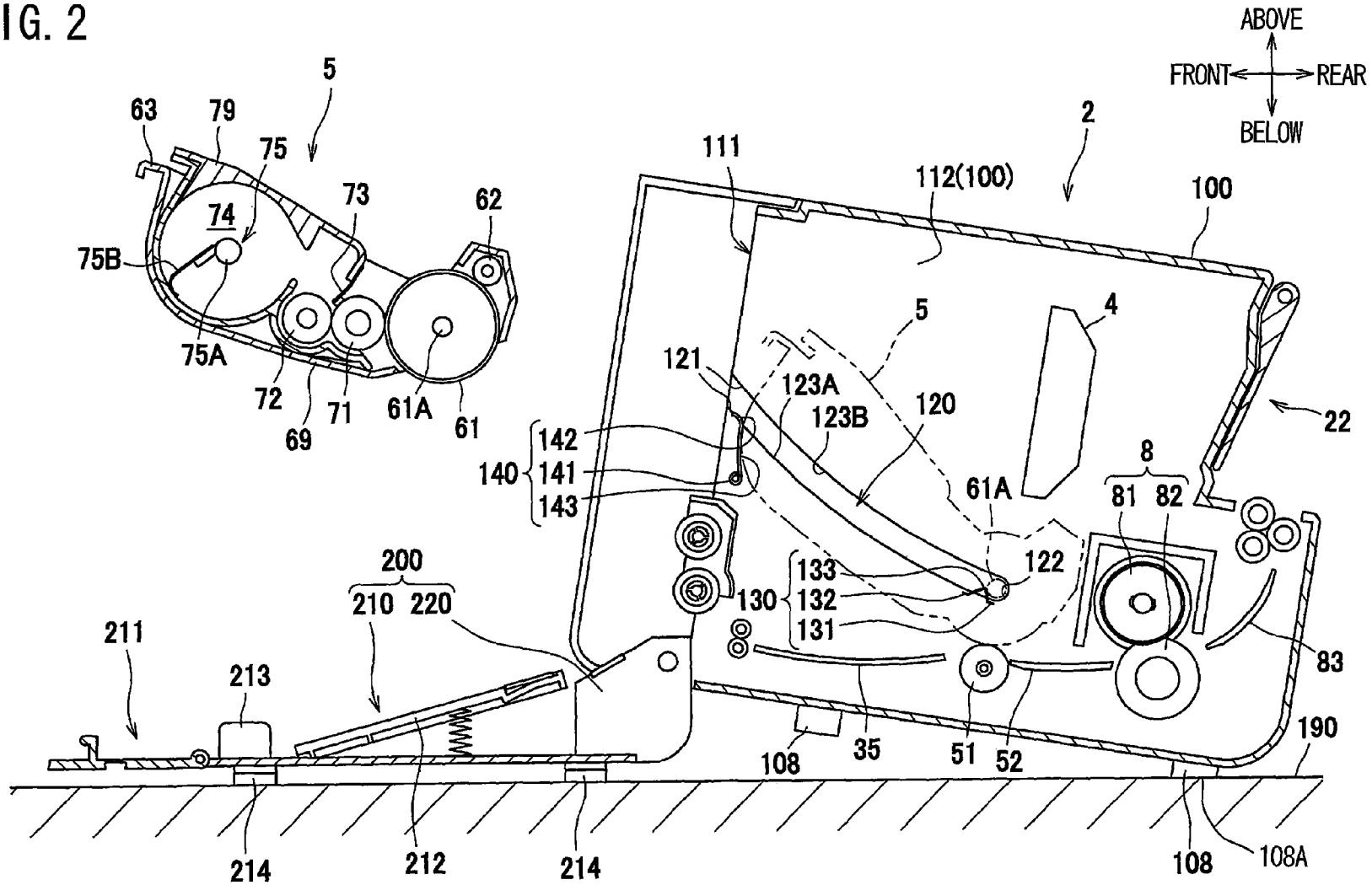
FIG. 2 is a cross-sectional view showing a second position of a first unit and a second unit in the laser printer according to the first embodiment.

A shaft bearing hole 225 is formed at each upper region of each lateral side wall 220A for rotatably supporting each support shaft 106 (described later, see FIGS. 3 and 5) of the first unit 2. The first unit 2 and the second unit 200 are pivotally movable relative to each other, such that the first unit 2 can be pivotally moved relative to the second unit 200 about the axis of the support shaft 106 between a first position as shown in FIG. 1 where the opening 111 is closed by the second unit 200 and a second position as shown in FIG. 2 where the opening 111 is exposed to an outside.

Figure 4:
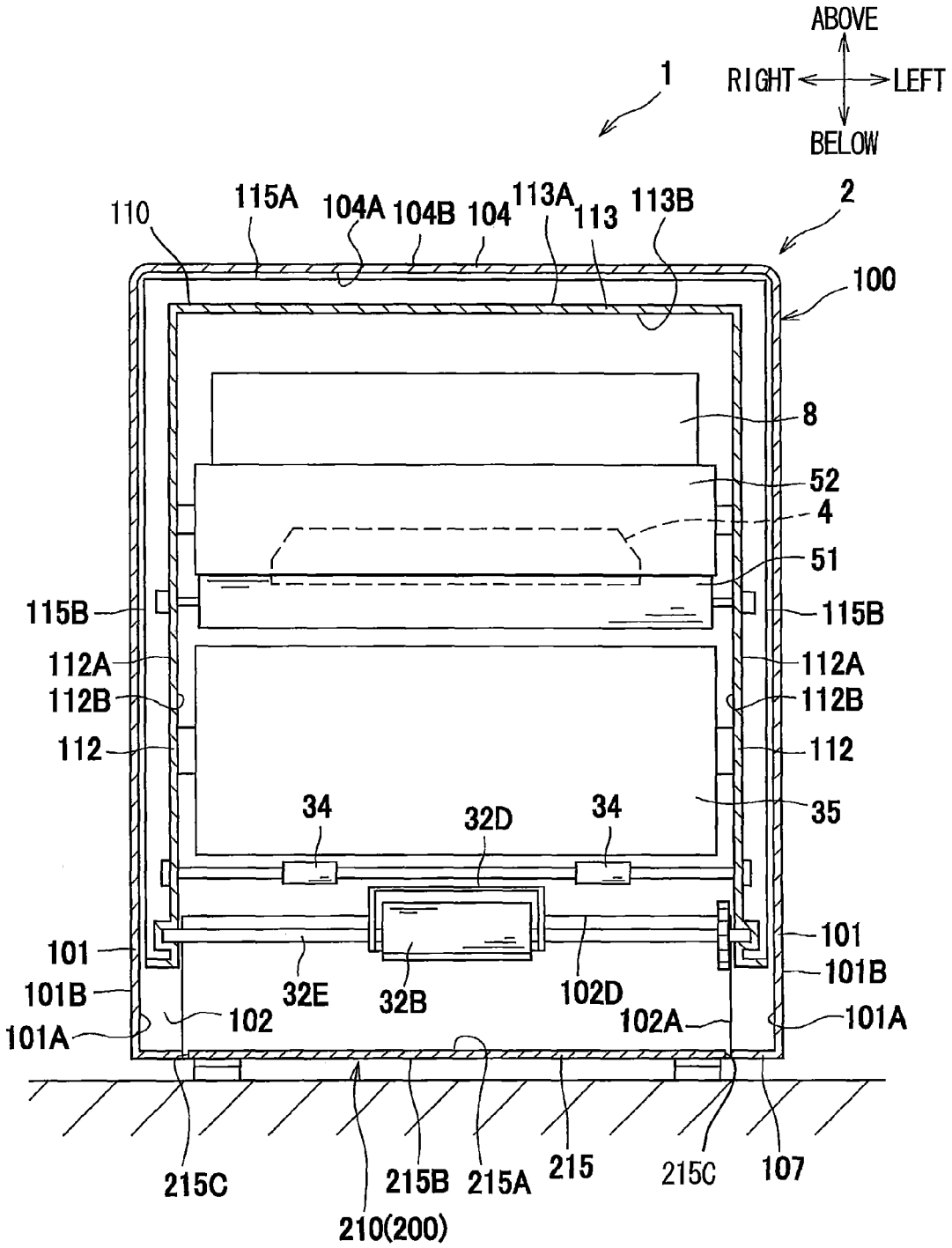
FIG. 4 is a cross-sectional view taken along the line Iv-Iv of FIG. 1.

As shown in FIG. 1, the sheet feed portion 32 provided at the second unit 200 includes a pick-up roller 32A, a separation roller 32B, a separation pad 32C, and a roller frame 32D. The pick-up roller 32A is configured to pick up each sheet P on the sheet supply tray 210, and is positioned above a rear end portion of the lifter plate 212. The separation roller 32B is positioned rearward of the pick-up roller 32A. The separation pad 32C is provided on the slant wall 222 at a position in confrontation with the separation roller 32B. The separation pad 32C is configured to separate a sheet P from a remaining sheet on the sheet supply tray 210. The pick-up roller 32A and the separation roller 32B are supported to the roller frame 32D which is supported to the main frame 110 through a rotation shaft 32E of the pick-up roller 32A as shown in FIG. 4.

In the feeder portion 3, a stack of the sheets P seated on the sheet supply tray 210 is lifted upward by the lifter plate 212, and is in contact with the pick-up roller 32A. Upon rotation of the pick-up roller 32A, the sheet P is delivered to the separation roller 32B. Further, an uppermost sheet P is separated from the remaining sheets at a position between the separation roller 32B and the separation pad 32C, so that each one of the sheet P can be conveyed to a conveyance passage 33.

The discharge portion 9 has a sheet discharge opening 91. The conveyance passage 33 extends to the sheet discharge opening 91 from a contacting position P1 where the pick-up roller 32A contacts the sheet P on the sheet supply tray 210. The conveyance passage 33 is provided by, from below, a first guide member 35, a second guide member 52, and a third guide member 83. The first guide member 35 has a front side guide surface 35A, and a rear surface 35B. The second guide member 52 has a front side guide surface 52A and a rear surface 52B. The third guide member 83 has a lower side guide surface 83A and an upper surface 83B. Along the conveyance passage 33, a pair of registration rollers 34, the process cartridge 5, the fixing unit 8 and the discharge portion 9 are provided.

The scanner unit 4 is positioned at a front side of the interior of the first unit 2 and between the sheet supply tray 210 and a sheet discharge tray 22 of the first unit 2. Further, the scanner unit 4 is positioned forward of and spaced away from a photosensitive drum 61 (described later). The scanner unit 4 includes a laser emitting portion, a polygon mirror, lenses, and a reflection mirror those not shown. The scanner unit 4 is configured to irradiate high speed scanning light onto a surface of the photosensitive drum 61. Incidentally, an LED head can be used as an exposure unit instead of the scanner unit 4.

The process cartridge 5 is positioned in the first unit 2 and above the sheet feed portion 32 and rearward of the scanner unit 4. The process cartridge 5 is detachable from the first unit 2 through the opening 111 as shown in FIG. 2 when the first unit 2 is at the second position. The process cartridge 5 includes a drum cartridge 6 and a developing cartridge 7.

As shown in FIGS. 1 and 2, the drum cartridge 6 includes a drum frame 69, the photosensitive drum 61 having a drum shaft 61A, and a charge roller 62 those provided at the drum frame 69. A hand grip 63 (FIG. 2) protrudes toward the opening 111 from the drum frame 69. Further, a transfer roller 51 is provided in the main frame 110 at a position confronting the photosensitive drum 61.

The developing cartridge 7 is attachable to and detachable from the drum frame 69 and includes a developing frame 79, a developing roller 71, a supply roller 72, a thickness regulation blade 73, a toner accommodating portion 74 as an example of an accommodating portion, and an agitator 75. The agitator 75 is rotatable in the toner accommodating portion 74 and includes an agitation shaft 75A and an agitation blade 75B. The toner accommodating portion 71 is configured to accommodate therein toner as an example of color material.

At the process cartridge 5, the surface of the rotating photosensitive drum 61 is exposed to light from the scanner unit 4 with high speed scanning, after the rotating surface is uniformly charged by the charge roller 62. Thus, electrical potential at the light-exposed region of the surface is lowered to form on the surface an electrostatic latent image on a basis of image data.

Then, the toner accommodated in the toner accommodating portion 74 is supplied to the electrostatic latent image formed on the surface of the photosensitive drum 61 through the supply roller 72 and the developing roller 71 to form a toner image on the surface. Then, the toner image carried on the surface of the photosensitive drum 61 is transferred onto the sheet P upon nipping the sheet P between the photosensitive drum 61 and the transfer roller 51. Then, the sheet P is conveyed toward the fixing unit 8.

The fixing unit 8 is configured to thermally fix the toner image onto the sheet P. As shown in FIG. 1, the fixing unit 8 is positioned above the process cartridge 5 and includes a heat roller 81 and a pressure roller 82.

At the fixing unit 8, thermal fixing of the toner image onto the sheet P is performed during travel of the sheet P through the heat roller 81 and the pressure roller 82. The thermally fixed sheet P is then conveyed to the discharge portion 9.

The discharge portion 9 includes a drive roller 92 and driven rollers 93A, 93B in contact with the drive roller 92 and rotatable by the rotation of the drive roller 92. The drive roller 92 and driven rollers 93A, 93B nip the sheet P therebetween for conveying the sheet P onto the sheet discharge tray 22 through the sheet discharge opening 91. A tray cover 23 is pivotally movably connected to an upper front end portion of the main casing 100. The sheet discharge tray 22 is provided by a part of the main casing 100 and the tray cover 23. More specifically, the sheet discharge tray 22 includes a main tray portion 22A located at a front part of an upper wall of the main casing 100, and an upper surface of the tray cover 23, the upper surface being an extension tray surface 23A when the tray cover 23 is pivotally moved frontward.

[Details of Main Casing 100 and Main Frame 110]

As shown in FIGS. 1 and 4, the main casing 100 includes lateral side walls 101, the front wall 102, a rear wall 103, and a top wall 104, these walls surrounding the main frame 110. Incidentally, in FIG. 4, the connecting portion 220, the process cartridge 5, the third guide member 83, and the sheet discharge portion 9 are not shown. Each lateral side wall 101 has an inner surface 101A and an outer surface 101B. The top wall 104 has an inner surface 104A and an outer surface 104B.

Figure 3:
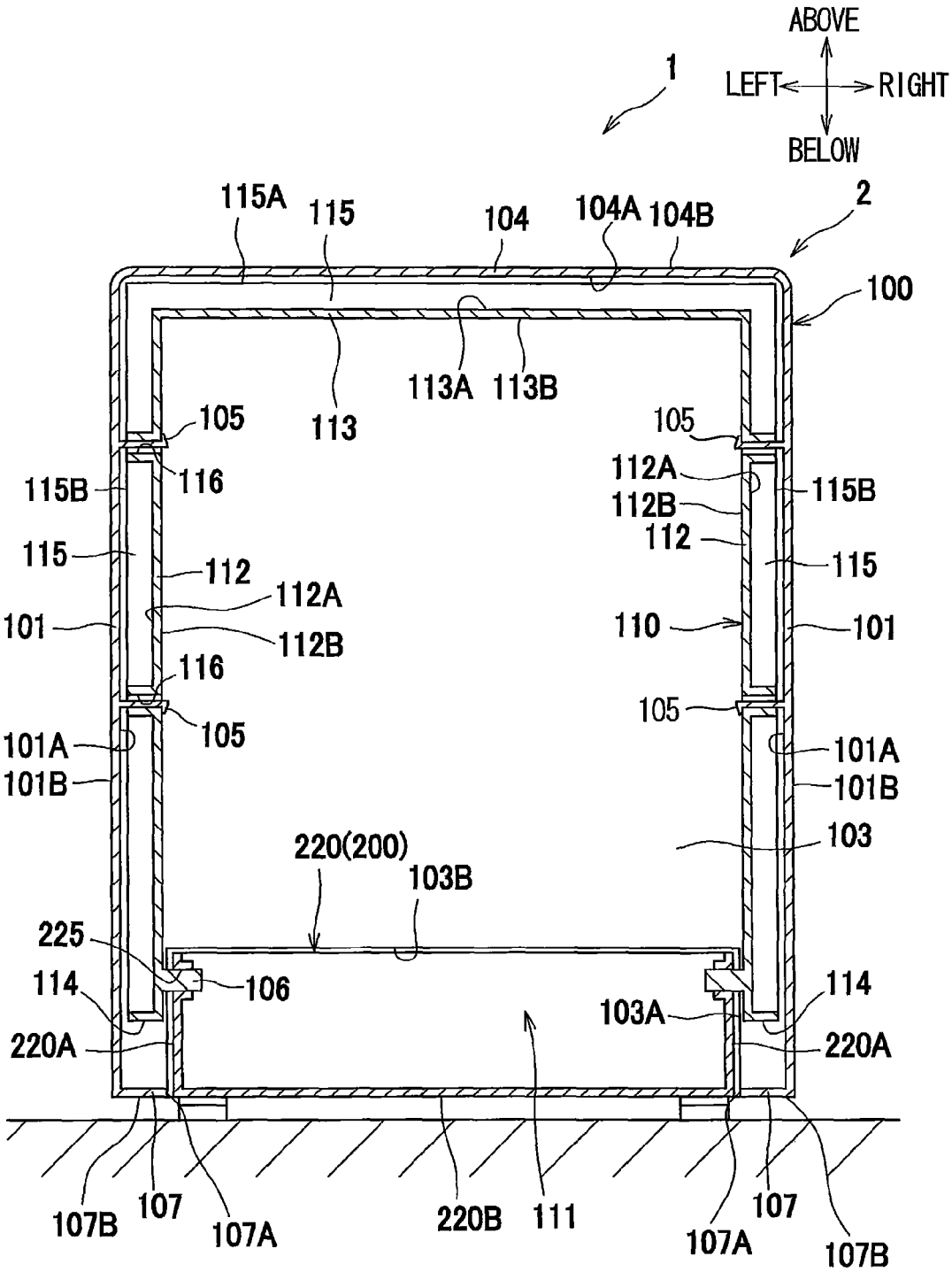
FIG. 3 is a cross-sectional view taken along the line III-III of FIG. 1.

As shown in FIG. 3, engagement pawls 105 and a flange 107 are provided at each of the lateral side walls 101. The engagement pawls 105 are configured to be engaged with the main frame 110, and protrude laterally inward from the inner surface 101A of each lateral side wall 101. One engagement pawl 105 is positioned at an upper portion of the side wall 101, and another engagement pawl 105 is positioned at a vertically center portion thereof, and totally four engagement pawls 105 are provided at the lateral side walls 101.

Figure 5:
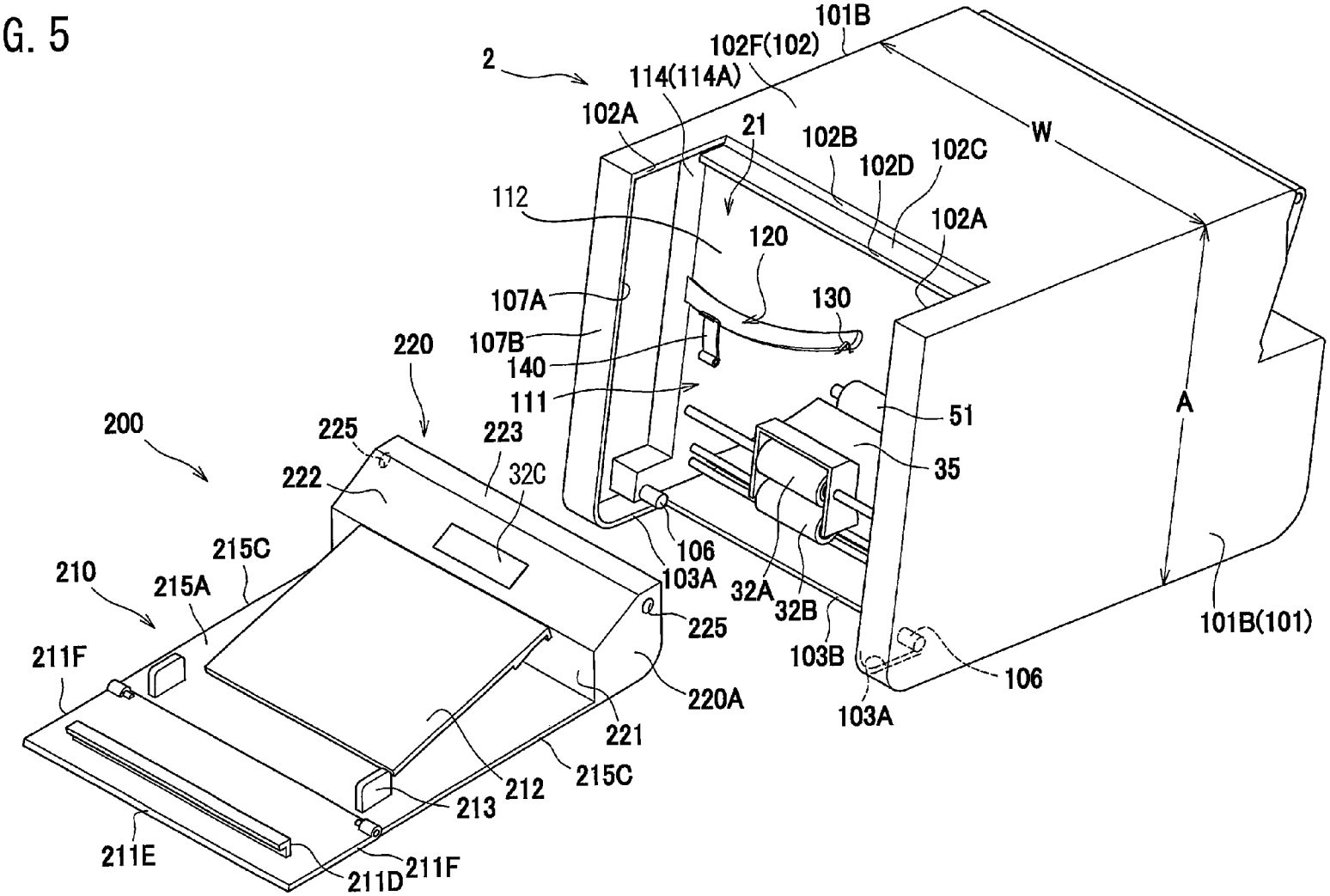
FIG. 5 is a perspective view of the first unit and a second unit of the laser printer according to the first embodiment.

Each flange 107 protrudes laterally inward from a lower end of each lateral side wall 101. As shown in FIGS. 3 through 5, each flange 107 has a distal end 107A positioned proximate to and out of contact from each side surface 215C of the bottom plate 215 and each lateral side wall 220A of the connecting portion 220. The main casing 100 provides a sufficient rigidity by the flanges 107. Each flange 107 has a lower surface 107B approximately flush with the lower surface 215B of the bottom plate 215 and with a lower surface 220B of the connecting portion 220.

The sheet insertion opening 21 formed at the lower end portion of the front wall 102 is profiled by lateral side edges 102A and an upper edge 102B. The sheet insertion opening 21 has an area allowing the front cover 211 to be fitted therewith. The engagement portion 102C extends downward from the upper edge 102B such that the engagement portion 102C is displaced rearward of the front cover 211 by a thickness of the front cover 211. The engagement portion 102C has a lower end 102D with which the pawl portion 211D of the front cover 211 is engageable. The lower end 102D defines an edge of the sheet insertion opening 21. Because an outer surface of the engagement portion 102C is displaced rearward (inward) by the thickness of the front cover 211, the outer surface 211A of the front cover 211 can be flush with the front outer surface 102F of the front wall 102 in frontward/rearward direction when the front cover 211 is closed where the inner surface 211C of the front cover 211 is in contact with the outer surface of the engagement portion 102C.

As shown in FIGS. 3 and 5, a lower end portion of the rear wall 103 is U-shaped, similar to the lower end portion of the front wall 102. That is, the lower end portion of the rear wall 103 is notched upward into U-shape to provide lateral side edges 103A and an upper edge 103B. The notched region is sized and positioned so as to avoid contact of the connecting portion 220 with these edges 103A, 103B. With this structure, relative pivotal motion between the first unit 2 and the second unit 200 does not provide mechanical interference between the connecting portion 220 and the rear wall 103. Further, the rear wall 103 has an outer surface 103C which is approximately flush with a rear surface of the rear wall 224 of the connecting portion 220. Reference numeral 103D designates an inner surface of the rear wall 103 (FIG. 1).

The front wall 102 and the rear wall 103 extend in a direction parallel to the pivot axis of the support shaft 106, and the rear wall 103 is positioned closer to the support shaft 106 than the front wall 102 is to the support shaft 106. Four stems 108 made from rubber protrude outward from the outer surface 103C of the rear wall 103. Two stems 108 are provided at an upper portion of the rear wall 103, and remaining two stems are provided at a lower portion thereof. The stems 108 have rear surfaces 108A seated on an installation surface 190 when the first unit 2 is pivotally moved rearward about the axis of the support shaft 106, so that the first unit 2 can be seated on the installation surface 190 through the stems 108.

As shown in FIG. 3, the main frame 110 is U-shaped including lateral side walls 112 and a top wall 113 to provide the opening 111 directing and opening downward. Each side wall 112 has an outer surface 112A and an inner surface 112B, and the top wall 113 has an upper outer surface 113A and a lower inner surface 113B.

Each lateral side wall 112 is formed with a through-hole 116 extending in the rightward/leftward direction, i.e., lateral direction at a position engageable with each engagement pawl 105. Upon engagement of the engagement pawl 105 with the through-hole 116, the main casing 100 is supported to the main frame 110.

The main frame 110 is also provided with a lower rib 114 protruding laterally outward from a lower end of each lateral side wall 112 as show in FIGS. 4 and 5, and pair of outline ribs 115 protruding laterally outward from front and rear ends of the lateral side walls 112 and protruding upward from front and rear ends of the top wall 113. Each outline rib 115 has an upper edge 115A and a side edge 115B.

As shown in FIG. 5, the lateral side wall 112 of the main frame 110 has a lower rear end portion provided with a pair of projecting portions projecting downward, and each support shaft 106 protrudes laterally inward from each projecting portion. As described above, the support shaft 106 is configured to provide pivotal movement between the first and the second unit 2 and 200, and each support shaft 106 is engaged with each shaft bearing hole 225 of the connecting portion 220. Incidentally, in FIG. 3, the upper edge 115A and the side edge 115B are spaced away from the main casing 100. However, at least one of the edges 115A, 115B can be partly in contact with the main casing 100. A combination of the support shaft 106 and the shaft bearing hole 225 serving as an example of a pivot connection portion is configured to provide a pivot connection between the first unit 2 and the second unit 200 such that the first unit 2 and the second unit 200 are pivotally movable relative to each other about the pivot axis.

As shown in FIGS. 1 and 2, the main frame 110 has a guide 120 configured to guide the process cartridge 5 to be positioned to an assembled position. The guide is positioned below and spaced away from the sheet discharge tray 22 and is open to the opening 111. The guide 120 is in a form of a groove having a width allowing the drum shaft 61A of the photosensitive drum 61 to move therethrough.

In FIG. 1, the guide 120 extends frontward and diagonally downward from an assembled position of the drum shaft 61A (In FIG. 1, the assembled position is at an upper end 122 of the guide 120) such that a lower end 121 of the guide 120 faces the sheet supply tray 210, more specifically faces the lifter plate 212. That is, the sheet supply tray is positioned below the guide 120. In other words, the lower end 121 of the guide 120 is directed toward the sheet supply tray 210.

In other words, the lower end 121 is positioned at the lower portion of the main frame 110 and is open to the opening 111. Thus, the process cartridge 5 can be ejected from the main casing 110 through the opening 111 after the first unit 2 is tilted rearward as shown in FIG. 2.

As shown in FIG. 2, a first leaf spring 130 and a second leaf spring 140 are provided at the main frame 110 at position adjacent to the guide 120. The first leaf spring 130 is positioned adjacent to the upper end 122 of the guide 120 and at a side of the transfer roller 51 (rearward of the guide 120). The first leaf spring 130 has one end portion 131 fixed to the main frame 110 at a side of the fixing unit 8, another end portion 132 fixed to the main frame 110 at a side of the opening 111, and a protruding portion 133 positioned between the one end portion 131 and the other end portion 132 and protruding toward the guide 120.

The drum shaft 61A is nipped between the protruding portion 133 and the upper end 122 of the guide 120 when the drum shaft 61A is positioned at the upper end 122, i.e., when the process cartridge 5 is at the assembled position. Thus, the drum shaft 61A of the process cartridge 5 can be held by the protruding portion 133 and the upper end 122 of the guide 120.

Further, the protruding portion 133 is displaceable toward the transfer roller 51. Therefore, the protruding portion 133 is displaced toward the transfer roller 51 by the pressure from the drum shaft 61A when a force directing toward the opening 111 is applied to the drum shaft 61A, so that the drum shaft 61A can be released from the protruding portion 133.

The second leaf spring 140 is positioned adjacent to the lower end 121 of the guide 120 and at the side of the transfer roller 51 (rearward of the guide 120). The second leaf spring 140 has a base end 141 fixed to the main frame 110, a free end 142 positioned close to the guide 120, and a support surface 143 configured to support a lower end of the process cartridge 5 positioned at the assembled position. The free end is positioned to contact the lower end of the process cartridge positioned at the assembled position. With this structure, the second leaf spring 140 can hold the process cartridge 5 at its assembled position in spite of the fact that the drum shaft 61A is urged to be moved toward the opening 111 due to the application of gravity of the process cartridge 5 to the drum shaft 61A.

The free end 142 is urged in a direction away from the opening 111, and is movable about an axis of the base end 141 toward the opening 111 against the urging force. That is, the free end 142 is displaced toward the opening 111 by the lower end of the process cartridge 5 when the process cartridge 5 is pulled toward the opening 111, so that the process cartridge 5 is released from the second leaf spring 140.

Further, the lateral side walls 112 of the main frame 110 support the fixing unit 8, the scanner unit 4, the transfer roller 51, the first guide member 35, and the second guide member 52, as shown in FIG. 4. The lateral side walls also support the third guide member 83, the pair of registration rollers 34, and the roller frame 32D. Further, the outer surface 112A of each lateral side wall 112 is provided with bearings for rotatably supporting a shaft of the transfer roller 51, shafts of the pair of registration rollers 34, and a shaft of the pick-up roller 32A.

[Dimensional Relationship Among Respective Components]

Figure 7:
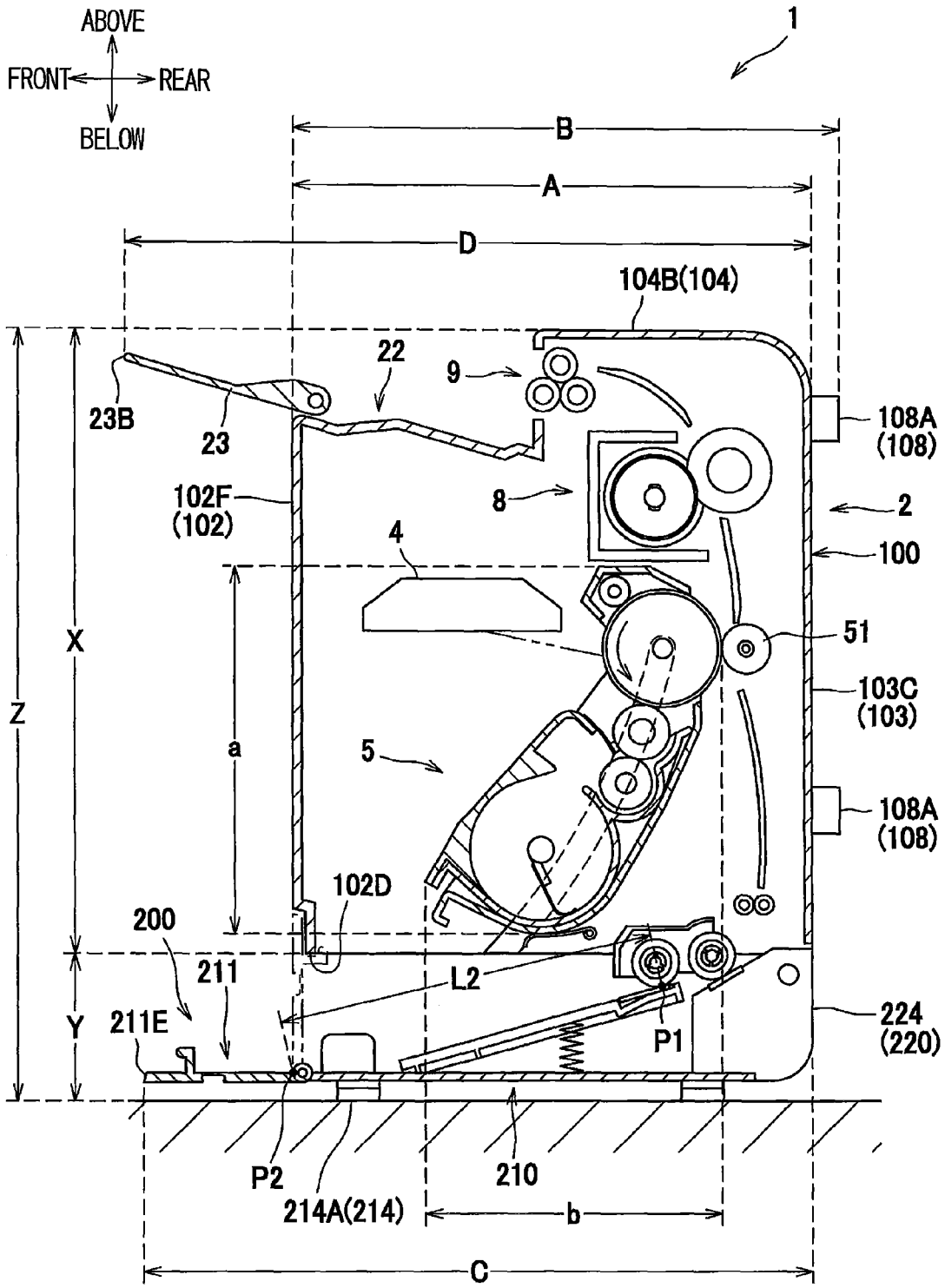
FIG. 7 is a view for description of dimensional relationship in the laser printer according to the first embodiment.

As shown in FIG. 7, the process cartridge 5 has a vertical dimension "a" preferably greater than a frontward/rearward dimension "b" in the state assembled in the first unit 2. Further, as shown in FIG. 5, a distance between the outer surfaces 101B of the main casing 100, i.e., a width "W" of the first unit 2 is preferably greater than a distance "A" between the front outer surface 102F and the rear outer surface 103C, and more preferably, "W" is greater than "2A".

Further, a weight "S" of the second unit 200 is preferably smaller than a weight "T" of the first unit 2, and more preferably "T" is greater than "3S".

Further, as shown in FIG. 7, in a state where the tray cover 23 is open, a distance "D" from a tip end 23B of the tray cover 23 to the rear outer surface 103C is preferably greater than a distance "B" and a distance "C", where the distance "B" is from the front outer surface 102F of the front wall 102 to the rear surface 108A of the stem 108, and the distance "C" is from a tip end 211E of the front cover 211 to the rear surface of the rear wall 224 in a state where the front cover 211 is open. In other words, the front cover 211 serving as an example of the outer portion is positioned outward of an outer surface 102F of the front wall 102 in a state where sheet is set on the sheet supply tray 210.

Here, a distance "X" from the lower end 102D of the engagement portion 102C to the upper outer surface 104B of the main casing 100 is preferably greater than a distance "Y" from the lower end 102D to a lower surface 214A of the bottom stem 214. More preferably, "X" is greater than "3Y". Further, a distance "Z" which is a sum of the distance "X" and the distance "Y" from the upper outer surface 104B to the lower surface 214A is preferably greater than the distance "D".

Further, a total length which is a sum of a length of the conveyance passage 33 and a length of the sheet supply tray 210 within the main casing 100 is smaller than 304.4 mm. More specifically, a sum of the length L1 and the length L2 is smaller than 304.4 mm, where the length L1 is a length of the conveyance passage 33 from the contacting position P1 at which the pick-up roller 32A is in contact with the sheet P on the sheet supply tray 210 to the sheet discharge opening 91, and the length L2 is from an intersection point P2 to the contacting position P1 where the intersection point P2 is at an intersection between the bottom surface of the sheet supply tray 210 and an extension surface which is an extension of the front outer surface 102F (an imaginary surface including the front outer wall 102F). More specifically, the intersection point P2 is at the intersection between the inner surface 211 C of the front cover 211 and the extension surface.

Incidentally, the length L1 of the conveyance passage 33 is a length of the sheet P that is bent in possible maximum amount during travel along the guide surfaces 35A, 52A, 83A of the guide members 35, 52, 83. With this structure, one of a leading end portion and a trailing end portion of the sheet can be exposed to an outside through the sheet discharge opening 91 or through the sheet insertion opening 21 when sheet jamming occurs, facilitating jamming sheet removal process.

Function and effect of the laser printer 1 will be described.

Figure 6:
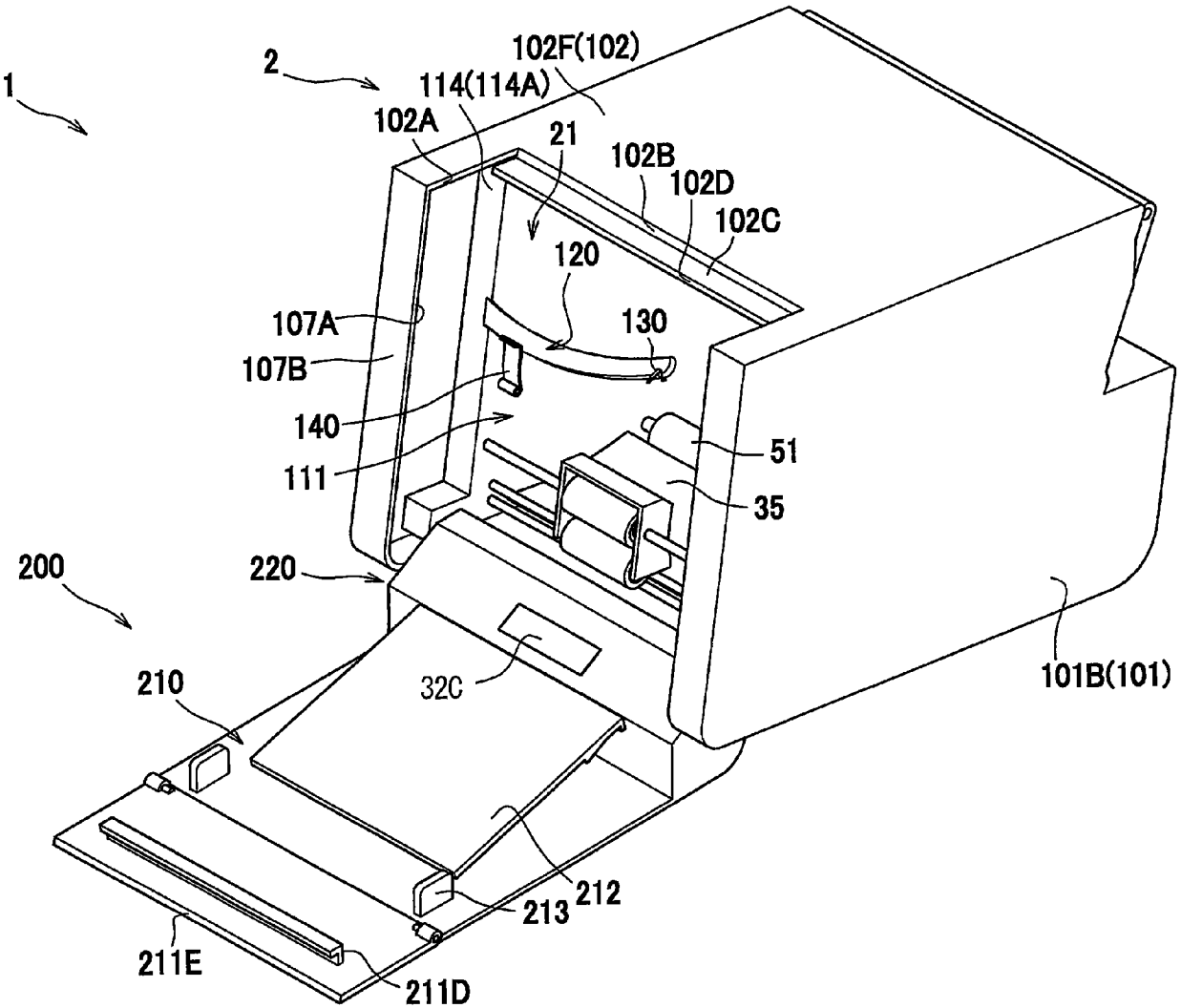
FIG. 6 is a perspective view of the laser printer in which the first unit and the second unit are at a first position.

Upon pivotal movement of the first unit 2, relative to the connecting portion 220 of the second unit 200 about the axis of the support shaft 106 from the first position to the second position, i.e., from a state shown in FIG. 1 to a state shown in FIG. 2, the opening 111 is exposed to the outside as shown in FIGS. 2 and 6. By grasping and pulling the process cartridge 5 toward the opening 111, the process cartridge 5 is moved along the guide 120, so that the process cartridge 5 can be taken out through the opening 111. Thus, the process cartridge 5 can be easily taken out from the first unit 2.

Further, upon movement to the second position, the opening 111 can be exposed to the outside. Thus, jammed sheet removing process can be facilitated.

Further, upon movement to the second position, the separation pad 32C provided at the sheet supply tray 210 and the separation roller 32B provided at the first unit 2 are separated away from each other, facilitating the jammed sheet removal process.

Further, the stem 108 made from rubber is provided at the rear wall 103. Therefore, the first unit 2 can be supported through the stem 108 when the first unit 2 is moved to the second position.

Incidentally, in the above-described embodiment, the first unit 2 is pivotally moved rearward relative to the second unit 200 without movement of the second unit 200. However, the second unit 200 can be pivotally moved frontward after printer 1 in its entirety is pulled down rearward to obtain the state shown in FIG. 2.

Figure 8:
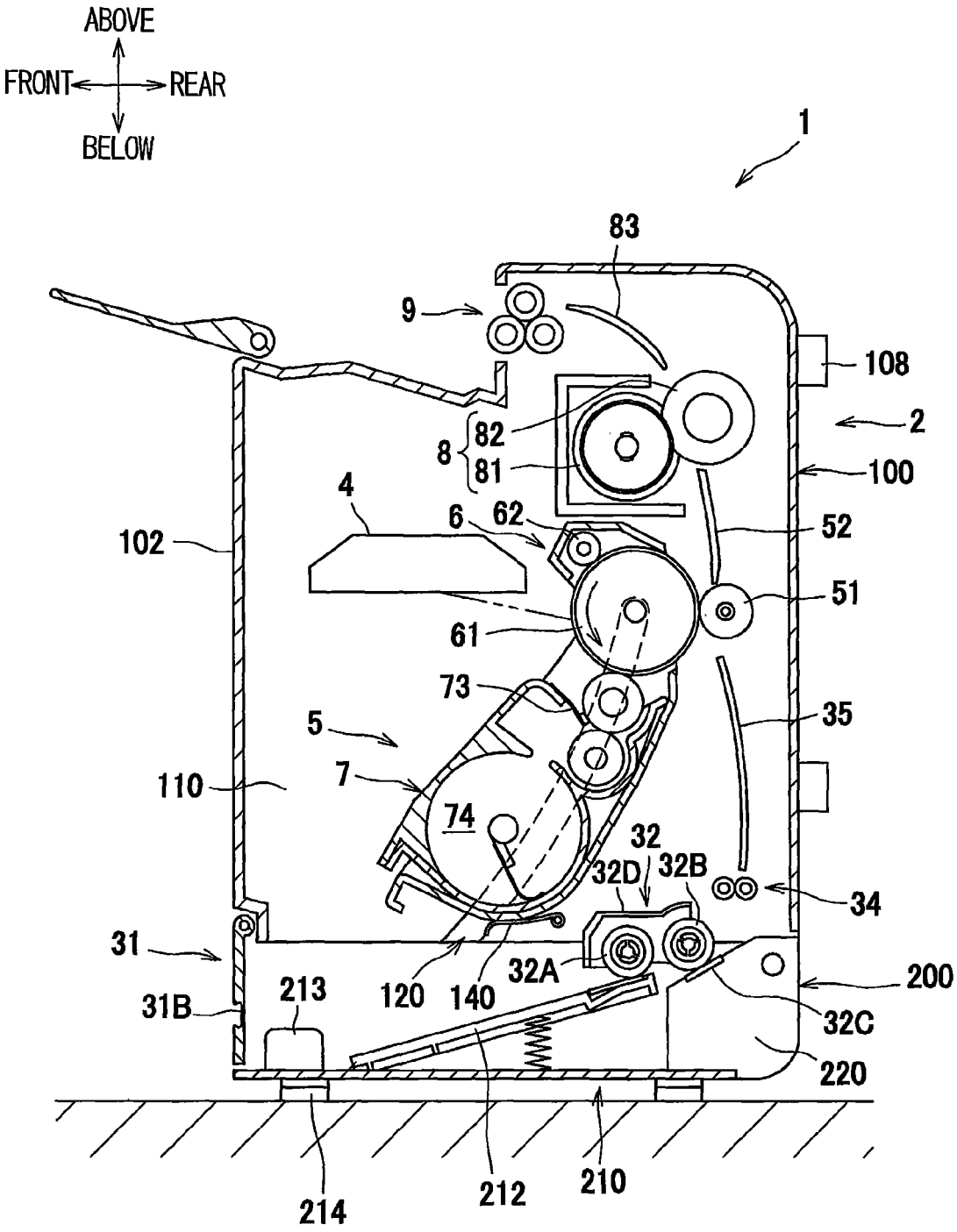
FIG. 8 is a cross-sectional view of a laser printer according to a first modification.

An image forming apparatus according to a first modification will next be described with reference to FIG. 8, wherein like parts and components are designated by the same reference numerals and characters as those shown in FIGS. 1 through 7. The image forming apparatus is a laser printer. According to the above-described embodiment, the front cover 211 is pivotally movably supported to the sheet supply tray 210. On the other hand, according to the first modification, a front cover 31 having a grasping portion 31B is pivotally movably supported to the lower end portion of the front wall 102 of the main casing 100. With this structure, the grasping portion 31B is pulled frontward for opening the front cover 31, thereby setting the sheet P on the sheet supply tray 210.

Figure 9:
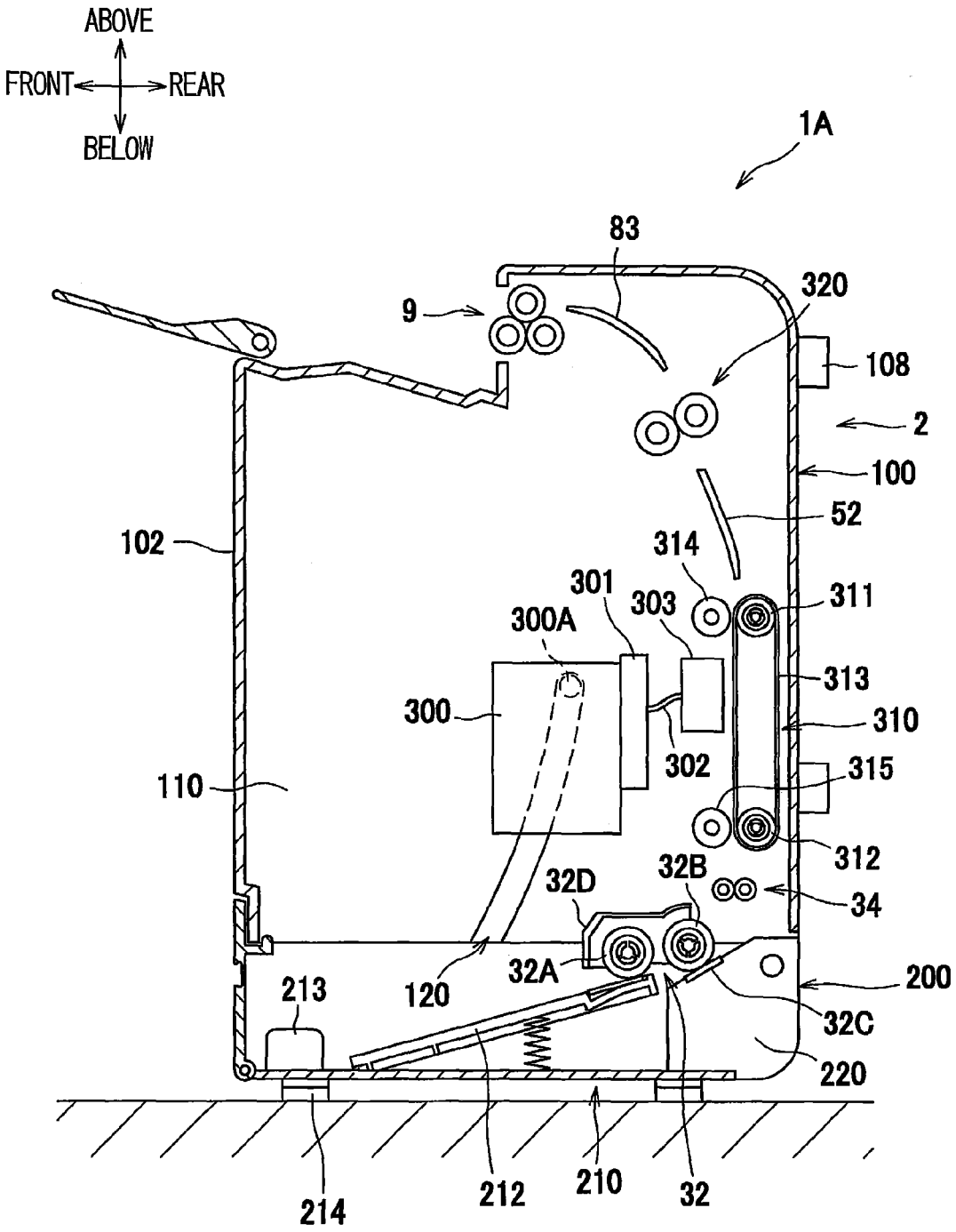
FIG. 9 is a cross-sectional view of an ink jet printer according to a second modification.

FIG. 9 shows an image forming apparatus according to a second modification in which the image forming apparatus is an ink jet printer 1A. In the above-described embodiment, the process cartridge 5 is exemplified as the cartridge. In contrast according to the second modification, an ink cartridge 300 in the ink jet printer 1A is an example of the cartridge.

Instead of the process cartridge 5 and the fixing unit 8 of the above-described embodiment, there are provided the ink cartridge 300, a holder 301 for holding the ink cartridge 300, an ink jet head 303, a tube 302 connecting the holder 301 to the ink jet head 303, and a conveyer mechanism 310 positioned in confrontation with the ink jet head 303.

The conveyer mechanism 310 includes a drive roller 311, a driven roller 312 positioned below the drive roller 311, an endless belt 313 mounted over the drive roller 311 and the driven roller 312, and feed rollers 314 and 315 positioned outside of the endless belt 313 and in confrontation with the drive roller 311 and the driven roller 312, respectively. Further, a pair of conveyer rollers 320 is provided above the conveyer mechanism 310.

A sheet P passing through the feed roller 315 is moved on the endless belt 313. During this movement, an ink as a color material is supplied from the ink cartridge 300 to the ink jet head 303 through the tube 302, and is ejected onto the sheet P from the ink jet head 303 to form an image. Then, the sheet P passes through the feed roller 314, and is delivered to the pair of conveyer rollers 310.

The ink cartridge 300 is provided with cartridge shafts 300A each extending laterally outward from the cartridge body. Each cartridge shaft 300A extends to be engaged with each guide 120, and is movable from the upper end to the lower end of the guide 120. With this structure, replacement of the ink cartridge 300 with a new cartridge can be facilitated by exposing the opening 111 at the second position of the first unit 2.

Figure 10A:
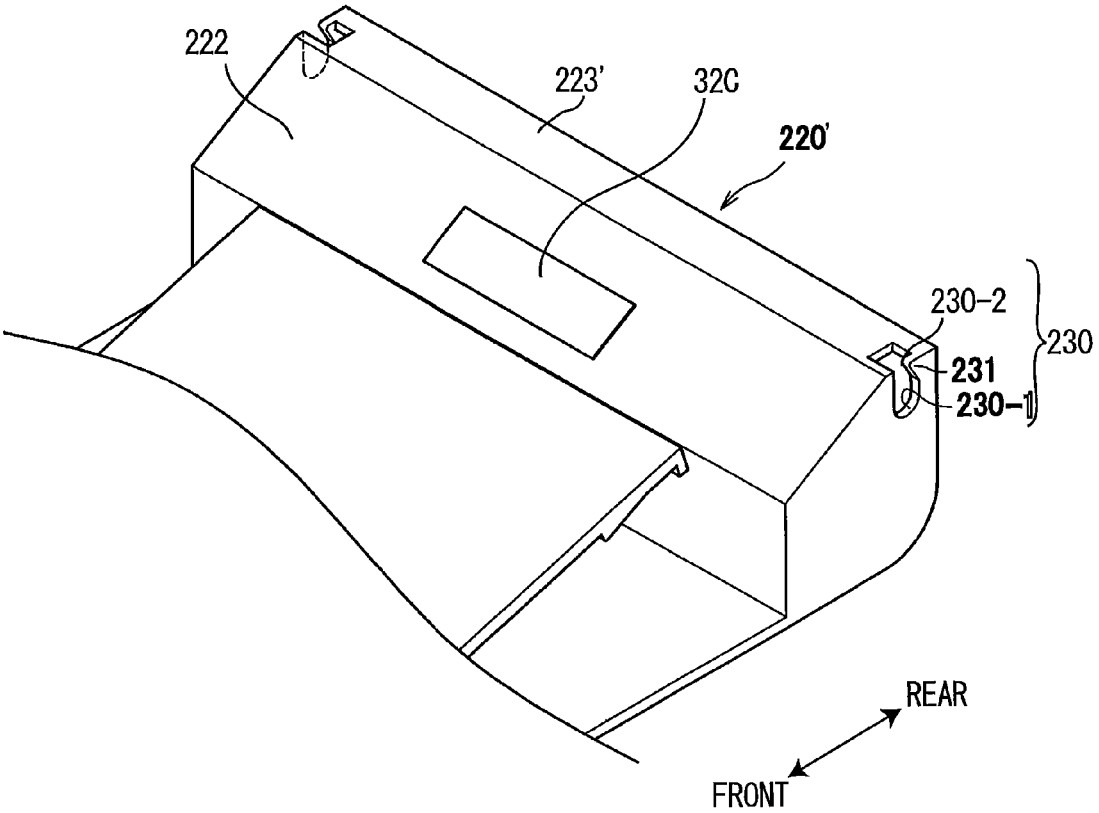
FIG. 10A is a partially enlarged perspective view of a connecting portion of a second unit in a laser printer according to a third modification.
Figure 10B:
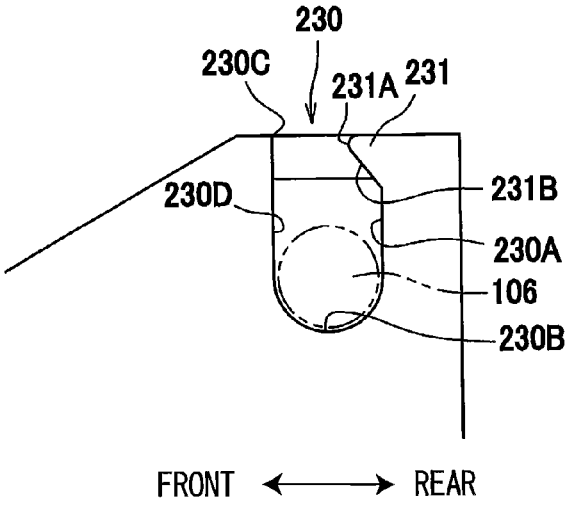
FIG. 10B is a partial enlarged view showing a groove of the connecting portion according to the third modification.

FIGS. 10A and 10B show a third modification concerning a connecting portion 220'. In the above-described embodiment, the connecting portion 220 is formed with the shaft bearing holes 225 for rotatably supporting the support shafts 106 of the main casing 100. On the other hand, according to the third modification, instead of the holes 225, notched portions 230 are formed in the connecting portion 220' for supporting the support shafts 106.

The notched portion 230 includes a first recessed portion 230-1 recessed downward in the side wall of the connecting portion 220', and a second recessed portion 230-2 formed in an upper wall 223' thereof. The first recessed portion 230-1 has a shape defined by a rear surface 230A, a bottom surface 230B, and a front surface 230D. Further, a projection 231 protrudes frontward from an upper end portion of the rear surface 230A. The projection 231 has a tip end 231A positioned at the upper portion of the recessed portion 230-1, and a slant surface 231B slanting diagonally downward and rearward from the tip end 231A. The second recessed portion 230-2 is connected to the first recessed portion 230-1 at a boundary between the side wall and the upper wall of the connecting portion 220'. The projection 231 reduces an open end area of the recessed portion 230-1. A combination of the support shaft 106 and the notched portion 230 is an example of the pivot connection portion.

With this structure, the support shafts 106 of the first unit 2 can be fitted with the connecting portion 220' from a position above the notched portion 230. The support shafts 106 are rotatable at the bottom surface 230B, and can be detached from the notched portion 230. Thus, the first unit 2 can be easily attached to and detached from the second unit 200. Further, because the projection 231 is provided, the tip end 231A of the projection 231 and a front upper end 230C of the front surface 230D define a narrow gap therebetween, which prevents the support shaft 106 from accidental release from the notched portion 230. Incidentally, the projection 231 can be provided at the front surface 230D.

Figure 11:
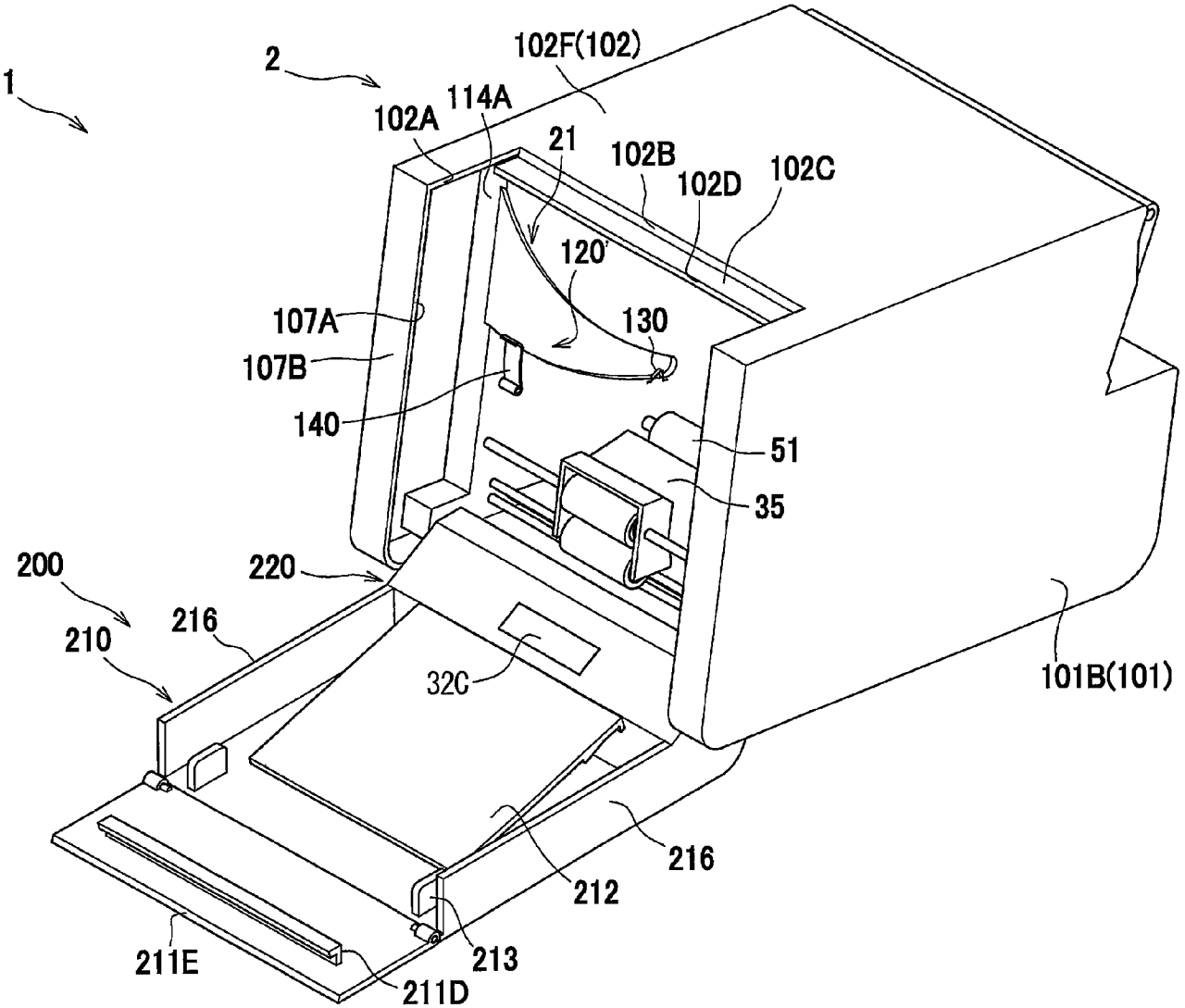
FIG. 11 is a perspective view of a first unit and a second unit of a laser printer according to a fourth modification.

An image forming apparatus according to a fourth modification is shown in FIG. 11. In the above-described embodiment, the guide 120 has an approximately uniform width slightly greater than the diameter of the rotation shaft 61A for allowing the rotation shaft 61A to move therethrough. On the other hand, according to the fourth modification, a guide 120' has a width increasing toward the opening 111.

Further, in the fourth modification, each side frame 216 extends upward from each lateral side of the sheet supply tray 210. The pair of side frame 216 can prevent the sheet P from being displaced laterally outward from the sheet supply tray 210.

Figure 12:
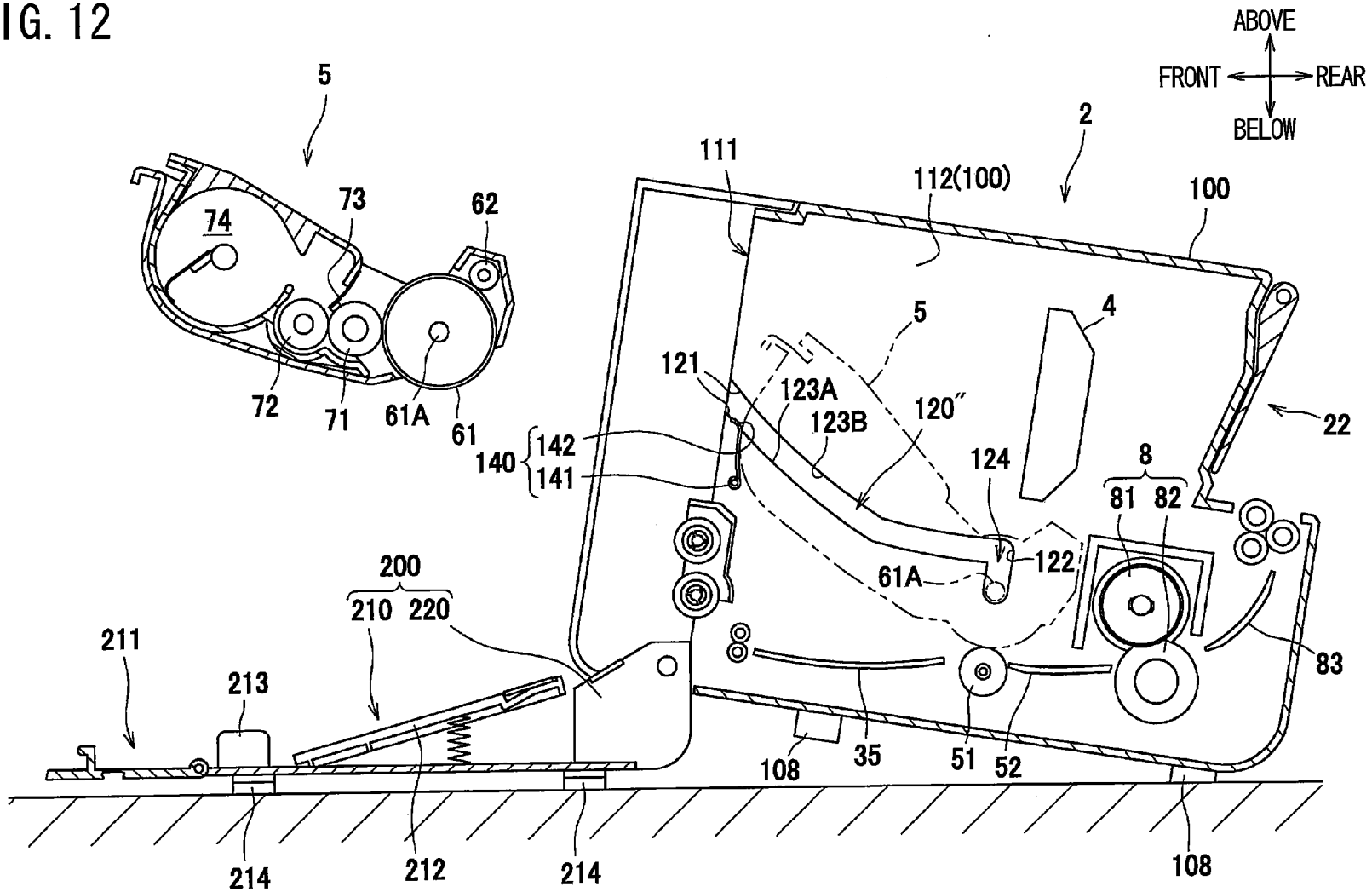
FIG. 12 is a cross-sectional view showing a second position of a first unit and a second unit in the laser printer according to a fifth modification.

An image forming apparatus according to a fifth modification is shown in FIG. 12. In the above-described embodiment, the first leaf spring 130 is provided adjacent to the upper end 122 of the guide 120. In contrast, in the fifth modification, the first leaf spring 130 is dispensed with. Instead, a guide 120" has a recessed portion 124 extending from its upper end 122 toward the transfer roller 51 to form an upper hook-like guide. The rotation shaft 61A of the photosensitive drum 61 can be fitted with the recessed portion 124 to hold the process cartridge 5 at a position.

Figure 13:
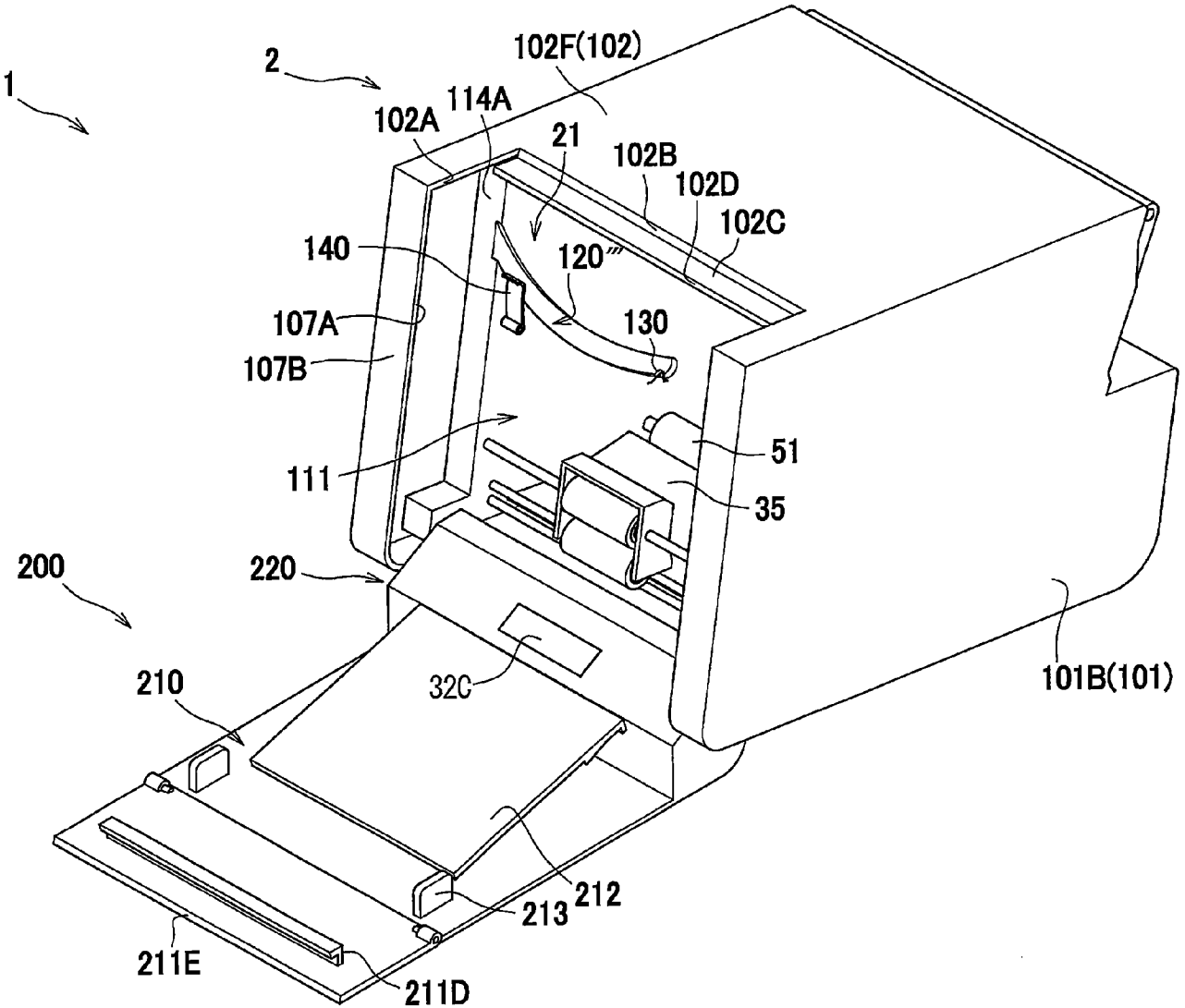
FIG. 13 is a perspective view of a first unit and a second unit of a laser printer according to a sixth modification.

An image forming apparatus according to a sixth modification is shown in FIG. 13. In the above-described embodiment, the lower end 121 of the guide 120 faces the lifter plate 212. In contrast, in the sixth modification, a lower end of a guide 120"' is directed toward the front wall 102, i.e., to a portion frontward of the lifter plate 212.

Further, in the above-described embodiment, the process cartridge 5 and the ink cartridge 300 are exemplified as the cartridge. However, a developing cartridge and a toner cartridge detachable from and attachable to a frame of the process cartridge are also available as the cartridge.

Further, in the above-described embodiment, the stems 108 are provided at the rear surface 103 of the main casing 100. However, the stems 108 can be dispensed with.

While the invention has been described in detail with reference to the above-described embodiments thereof, it would be apparent to those skilled in the art that various changes and modifications may be made therein without departing from the spirit of the invention.

What is claimed is:

1. An image forming apparatus comprising:

a cartridge including:

a photosensitive drum having a drum shaft; and an accommodating portion configured to accommodate an image formation material to be supplied to the photosensitive drum;

a first unit comprising:

a sheet discharge tray;

a guide positioned below the sheet discharge tray and configured to guide the cartridge to its assembled position, the first unit having an opening, the guide having an upper end and a lower end proximate to the opening, the guide extending upward from the lower end to the upper end; and a support portion positioned adjacent to the lower end of the guide and configured to support the cartridge at an assembled position of the cartridge; and a second unit disposed below the first unit and comprising a sheet supply tray positioned below the guide, the first unit and the second unit being connected to each other such that the first unit pivots about a pivot axis relative to the second unit between a first position and a second position, wherein, when the first unit is in the first position, the first unit is positioned above the second unit such that the first unit covers the sheet supply tray of the second unit and the second unit closes the opening, which is directed downward, of the first unit, the drum shaft of the photosensitive drum of the cartridge located at its assembled position is positioned at the upper end of the guide extending upward from the lower end proximate to the opening of the first unit, and the support portion positioned adjacent to the lower end of the guide supports a lowest portion of the cartridge located at the assembled position, the lowest portion of the cartridge located at the assembled position being closer to the accommodating portion than to the photosensitive drum, and wherein, when the first unit is in the second position, the lower end of the guide of the first unit is exposed to an outside without being directed to the sheet supply tray, and the sheet supply tray of the second unit is not covered by the first unit.

2. The image forming apparatus as claimed in claim 1, wherein the first unit further comprises a pick-up roller configured to pick up a sheet on the sheet supply tray.

3. The image forming apparatus as claimed in claim 2, wherein the second unit further comprises:

a pressure member configured to press a sheet on the sheet supply tray toward the pick-up roller; and a separation pad configured to separate a sheet from a remaining sheet on the sheet supply tray; and wherein the first unit further comprises a separation roller facing the separation pad in the first position.

4. The image forming apparatus as claimed in claim 2, wherein the first unit has an outer wall surface;

wherein the sheet supply tray has a lower surface and an outer portion that is positioned outward of the outer wall surface in a state where a sheet is set on the sheet supply tray;

wherein the pick-up roller provides a contacting position at which the pick-up roller is in contact with the sheet;

wherein the first unit has a sheet discharge opening through which a sheet is discharged onto the sheet discharge tray, a sheet conveyance passage having a first length being defined from the contacting position to the sheet discharge opening, and wherein a second length is defined from an intersection between the lower surface of the sheet supply tray and an imaginary surface including the outer wall surface to the contacting position, the first length and the second length providing a combined length smaller than 304.4 mm.

5. The image forming apparatus as claimed in claim 1, wherein the first unit further comprises:

walls extending in a direction parallel to the pivot axis; and a stem protruding outward from one of the walls positioned closer to the pivot axis than a remaining one of the walls to the pivot axis, the stem being configured to, when the first unit is in the second position, support the first unit by contacting a surface on which the second unit is disposed.

6. The image forming apparatus as claimed in claim 1, wherein the first unit has a support shaft; and wherein the second unit has a notched portion recessed downward and configured to rotatably support the support shaft.

7. The image forming apparatus as claimed in claim 6, wherein the notched portion has a projection that reduces an open end area of the notched portion.

8. The image forming apparatus as claimed in claim 1, further comprising:

a pivot connection portion having the pivot axis and configured to provide a pivot connection such that the first unit pivots about the pivot axis relative to the second unit between the first position and the second position.

9. The image forming apparatus as claimed in claim 8, wherein the pivot connection portion comprises:

a support shaft extending from the first unit; and a notched portion formed at the second unit, the notched portion having a recessed portion recessed downward and configured to rotatably support the support shaft.

10. The image forming apparatus as claimed in claim 9, wherein the notched portion has a projection that reduces an open end area of the recessed portion.

11. The image forming apparatus as claimed in claim 3, wherein the separation roller is spaced away from the separation pad when the first unit is in the second position.

12. The image forming apparatus as claimed in claim 1, wherein the image formation material includes toner.

13. The image forming apparatus as claimed in claim 1, wherein, in the second position, the lower end of the guide of the first unit is located above the upper end of the guide and in communication with the opening.

14. The image forming apparatus as claimed in claim 1, wherein the first unit includes an urging member having the support portion.

* * * * *